US009612027B2

(12) United States Patent
Tolkamp et al.

(10) Patent No.: US 9,612,027 B2
(45) Date of Patent: Apr. 4, 2017

(54) COOLING SYSTEM FOR FORMING A MIST AND METHODS OF REPAIRING OR REPLACING A COMPONENT THEREOF

(71) Applicant: CIM-Tech, Inc., Valparaiso, IN (US)

(72) Inventors: Rudy C. Tolkamp, Demotte, IN (US); Brian P. Greubel, Valparaiso, IN (US)

(73) Assignee: CIM-Tech, Inc., Valparaiso, IN (US)

( * ) Notice: Subject to any disclaimer, the term of this patent is extended or adjusted under 35 U.S.C. 154(b) by 575 days.

(21) Appl. No.: 14/157,075

(22) Filed: Jan. 16, 2014

(65) Prior Publication Data

US 2014/0196487 A1 Jul. 17, 2014

Related U.S. Application Data

(60) Provisional application No. 61/753,131, filed on Jan. 16, 2013.

(51) Int. Cl.

| | |
|---|---|
| ***C21C 1/00*** | (2006.01) |
| ***C21C 5/00*** | (2006.01) |
| ***F24F 6/12*** | (2006.01) |
| ***F27D 1/12*** | (2006.01) |
| ***C21B 7/10*** | (2006.01) |
| ***F27B 1/10*** | (2006.01) |
| ***F27B 1/24*** | (2006.01) |
| ***F27D 9/00*** | (2006.01) |

(52) U.S. Cl.

CPC ..... *F24F 6/12* (2013.01); *C21B 7/10* (2013.01); *F27B 1/10* (2013.01); *F27B 1/24* (2013.01); *F27D 1/12* (2013.01); *F27D 9/00* (2013.01)

(58) Field of Classification Search

CPC ..... F24F 6/12; F27D 9/00; F27D 1/12; F27B 1/24

USPC ..... 266/190, 192, 241

See application file for complete search history.

(56) References Cited

U.S. PATENT DOCUMENTS

| | | | | |
|---|---|---|---|---|
| 4,815,096 | A * | 3/1989 | Burwell | F27D 9/00 373/74 |
| 5,350,158 | A * | 9/1994 | Whellock | C21C 5/4606 266/225 |
| 6,152,729 | A * | 11/2000 | Rinker | C21B 13/105 266/173 |
| 8,328,551 | B2 * | 12/2012 | Orbeck | B23K 1/008 432/128 |
| 2003/0116091 | A1 * | 6/2003 | Grant | C23C 16/4486 118/726 |
| 2013/0177860 | A1 * | 7/2013 | Hamid | C21D 1/62 432/85 |

* cited by examiner

*Primary Examiner* — Allen Flanigan
*Assistant Examiner* — Filip Zec
(74) *Attorney, Agent, or Firm* — Hartman Global IP Law; Gary M. Hartman; Michael D. Winter

(57) ABSTRACT

Cooling system and method suitable for cooling a blast furnace with a cooling fluid during its operation. The cooling system includes a source of a gaseous fluid that feeds the gaseous fluid to multiple flow paths. A liquid is atomized into each of the multiple flow paths, within which the atomized liquid is mixed with the gaseous fluid to form a mist. The system further includes means for selectively closing each of the multiple flow paths while at least one other of the multiple flow paths remains open.

20 Claims, 2 Drawing Sheets

FIG. 1
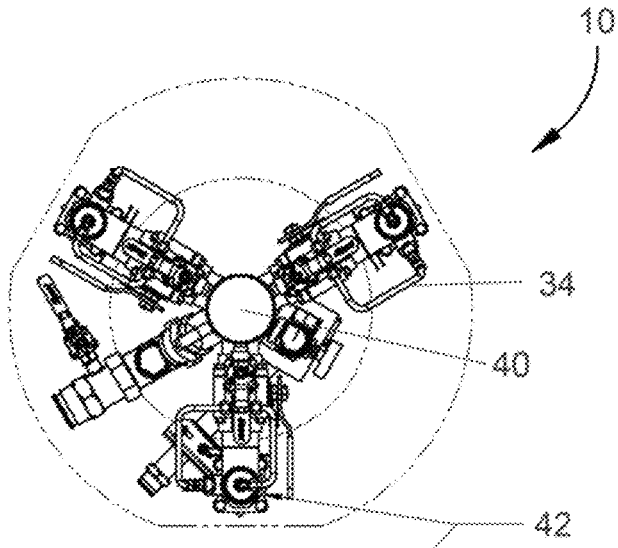
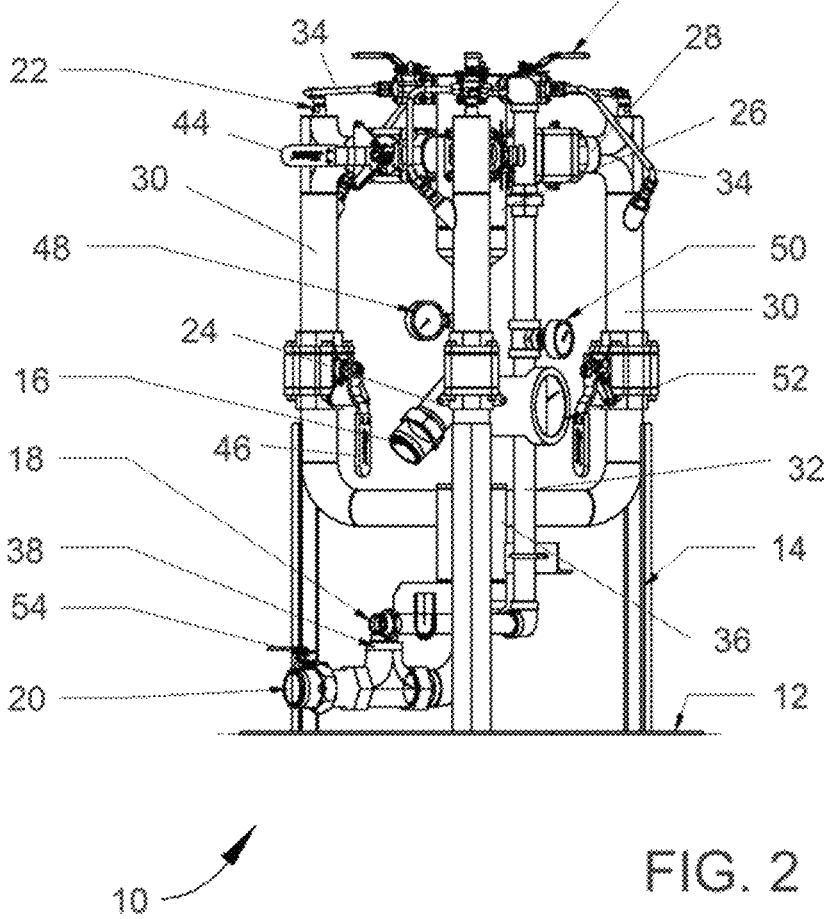
FIG. 2

COOLING SYSTEM FOR FORMING A MIST AND METHODS OF REPAIRING OR REPLACING A COMPONENT THEREOF

CROSS REFERENCE TO RELATED APPLICATIONS

This application claims the benefit of U.S. Provisional Application No. 61/753,131, filed Jan. 16, 2013, the contents of which are incorporated herein by reference.

BACKGROUND OF THE INVENTION

The present invention generally relates to cooling systems. More particularly, this invention relates to a cooling system suitable for providing a cooling fluid to a blast furnace during operation.

Water is the typical cooling fluid used by cooling systems within blast furnaces, for example, of types used in iron-making processes. During the life of a blast furnace, passages within the cooling system that deliver the cooling fluid to the blast furnace may deteriorate and/or become damaged, thereby allowing water to leak from the system into the high temperature process within the furnace. A leak in the cooling system changes the dynamics of the cooling system, impacts the reaction in the furnace, and decreases the performance and efficiency of the furnace. Moreover, if the leak is not detected in a timely manner and water is injected into the furnace, hydrogen is produced resulting in dangerous safety conditions and causing erosion in the furnace walls, dome, and hearth that can be expensive and time consuming to repair. Therefore, when a leak occurs in the cooling system, water can most likely no longer be used as the cooling medium in the cooling system. However, cooling must to be restored to prolong the furnace life.

In view of the above, once a leak has been detected in a cooling system for a blast furnace, the cooling system must be promptly replaced, repaired, or modified or an alternative cooling fluid must be used. One approach to repair or modify a cooling system is to insert a small diameter metallic hose into the passage where a leak has occurred, and then fill the annular gap between the hose and the surrounding passage with grout. Water can then once again be used as the cooling fluid. However, the grout is often much more insulating than the original passage walls, with the result that effective cooling may be compromised. In addition, the time to install the hose and grout the gap between the hose and passage may require an extended outage of the blast furnace. In addition, the diameter of the hose is less than the original passages and therefore restricts the quantity of water that can be used for cooling. As a result, the heat removal capacity within the blast furnace is likely reduced.

Another approach is to use dry nitrogen in place of water as the cooling media. Dry nitrogen is used because it is readily available and has minimal effect on the blast furnace process even if some of the nitrogen leaks into the furnace process. However, nitrogen has a limited cooling effectiveness due to its very low heat capacity. Therefore, as with the previous cooling system repair, the heat removal capacity within the blast furnace is likely reduced.

A cooling system commercially available under the name CIM-Cooler, produced by CIM-Tech, Inc., has provided an alternative approach wherein the cooling water is replaced with a nitrogen mist comprising nitrogen mixed with atomized water. The nitrogen mist has significantly greater heat removal capacity relative to dry nitrogen. While this system provides significant improvements over the two previously described approaches, spray nozzles used by the system to atomize water may become plugged or damaged, necessitating that the blast furnace be taken offline in order to repair or replace the spray nozzles.

In view of the above, it can be appreciated that there is a desire for cooling systems that are capable of delivering a cooling fluid to a blast furnace during operation that has a heat removal capacity comparable to water-based cooling systems, but can be repaired without taking the blast furnace offline.

BRIEF DESCRIPTION OF THE INVENTION

The present invention provides a cooling system and method thereof suitable for cooling a blast furnace with a cooling fluid during its operation. The cooling system preferably provides a heat removal capacity comparable to water-based cooling systems and can be repaired without taking the blast furnace offline.

According to one aspect of the invention, a cooling system includes a source of a gaseous fluid that feeds the gaseous fluid to multiple flow paths. A liquid is atomized into each of the multiple flow paths, within which the atomized liquid is mixed with the gaseous fluid to form a mist. The system further includes means for selectively closing each of the multiple flow paths while at least one other of the multiple flow paths remains open.

Another aspect of the invention is a method of repairing or replacing a component along an individual flow path of one of the multiple flow paths of the cooling system described above. The method includes preventing the liquid and gaseous fluid from entering the individual flow path, isolating the individual flow path from other of the multiple flow paths, and repairing or replacing the component of the individual flow path.

A technical effect of the invention is the ability to provide cooling to a high temperature process, such as a blast furnace, with a heat removal capacity comparable to water-based cooling systems and to be able to repair the cooling system without taking the blast furnace offline. In particular, it is believed that, by providing the mist through multiple separate flow paths, each of which may be individually closed, the system can be repaired while nitrogen mist is continued to be provided to the blast furnace by the other open flow paths.

Other aspects and advantages of this invention will be better appreciated from the following detailed description.

BRIEF DESCRIPTION OF THE DRAWINGS

FIGS. 1 and 2 are top and side views, respectively, representing a cooling system in accordance with an aspect of this invention.

DETAILED DESCRIPTION OF THE INVENTION

Figure 3:
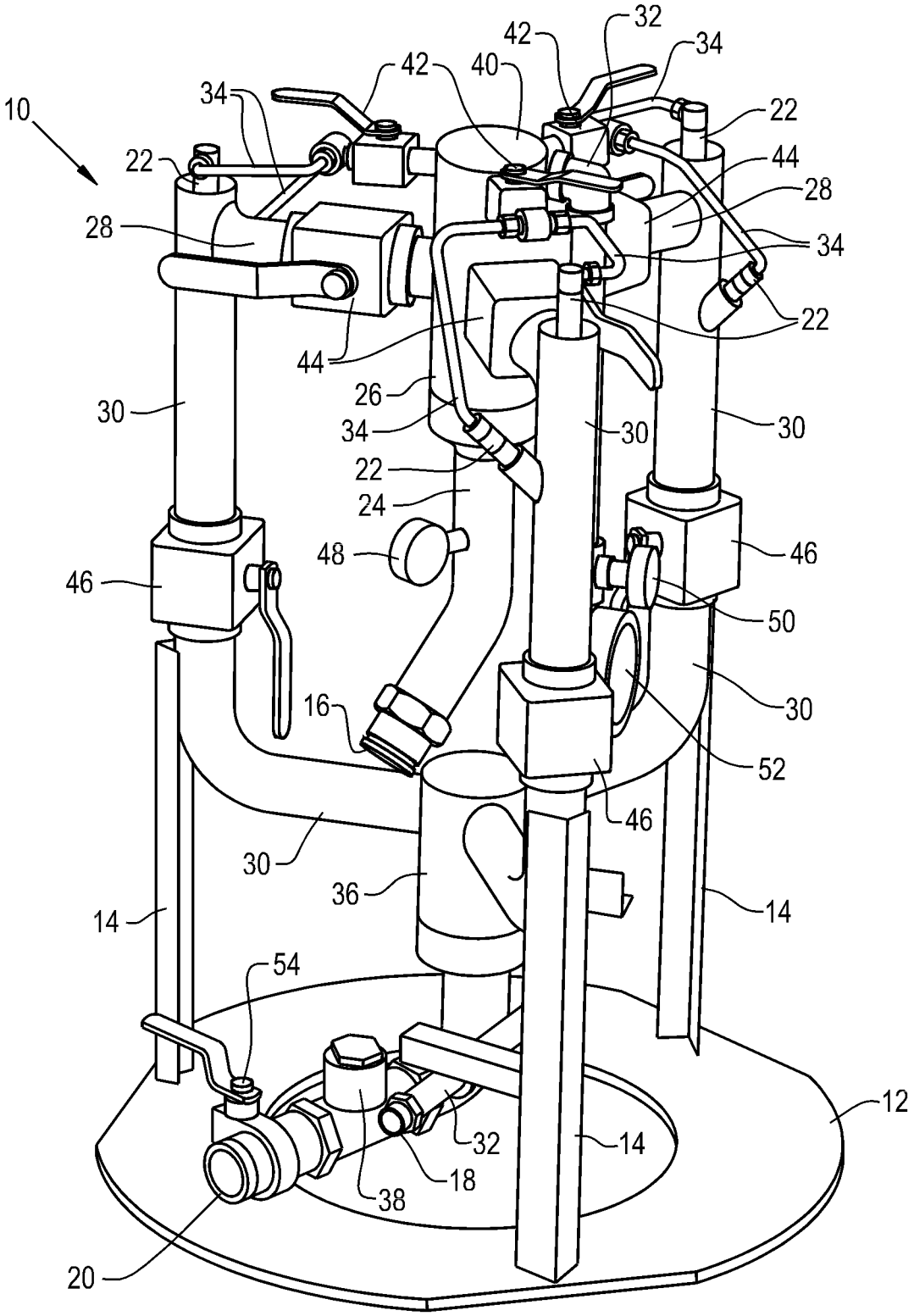
FIG. 3 is a perspective view of the cooling system of FIG. 1.

The present invention is generally applicable to cooling systems adapted to use a cooling fluid, such as cooling systems within blast furnaces that in the past have utilized water or dry nitrogen as the cooling fluid. Although the invention is described in reference to blast furnaces in the iron making industry, the invention has application to other industries, systems, and fluids.

To facilitate the description of the cooling system 10 provided below, terms such as "vertical," "horizontal," "side," "upper," "lower," "above," "below," "right," "left," etc., will be used in reference to the orientation of the cooling system 10 in FIGS. 2 and 3, and therefore are relative terms and should not be otherwise interpreted as limitations to the construction and use of the cooling system 10 or as limiting the scope of the invention.

FIGS. 1 through 3 represent a cooling system 10 configured to provide a cooling fluid within a blast furnace. According to an aspect of the present invention, the cooling system 10 is adapted to produce a stream of nitrogen and atomized water, referred to herein as nitrogen mist, to be used as the cooling fluid. The cooling system 10 is believed to be an improvement over the function and construction of a cooling system commercially available under the name CIM-Cooler produced and sold by CIM-Tech, Inc. In particular, the cooling system 10 preferably produces a nitrogen mist similar to that produced by the CIM-Cooler, which is capable of minimizing water intrusion into the iron making process while maintaining an improved level of cooling over certain other prior art processes. Also similar to the CIM-Cooler, the cooling system 10 may be used as a replacement for pre-existing water-based cooling systems used in blast furnaces. In the event of a failure, water-based cooling systems may leak water directly into the process, which is undesirable and potentially dangerous. It is foreseeable that the cooling system 10 could be used with combinations of gaseous fluids and liquids other than nitrogen and water, depending on the application.

FIGS. 1 and 2 are top and side views, respectively, representing the cooling system 10. The nonlimiting embodiment of the cooling system 10 represented in the Figures comprises three legs 14 secured to a base 12. Dry nitrogen and water are fed into the cooling system 10 at a nitrogen inlet 16 and water inlet 18, respectively. Nitrogen introduced into the system 10 through the inlet 16 travels up through a nitrogen inlet tube 24 and is then split into three flows, preferably substantially equal in volumetric flow rate, by a nitrogen junction 26. Alternatively, each nitrogen flow within the cooling system 10 could have its own source of nitrogen (or other suitable dry gas), thereby eliminating the need for separating a single inlet flow with the junction 26. From the junction 26, each nitrogen flow travels through one of three horizontal tubes 28 to one of three vertical outlet tubes 30 supported by the legs 14.

Water introduced into the system 10 through the inlet 18 travels up through a water inlet tube 32 and is split into three flows, preferably substantially equal in volumetric flow rate, by a water junction 40. Alternatively, each water flow within the cooling system 10 could have its own source of water (or other suitable liquid), thereby eliminating the need for separating a single inlet flow with the junction 40. From the junction 40, each water flow travels horizontally through one of six pipes 34 to a corresponding number of spray nozzles 22, each located at either the top of an outlet tube 30 or at an upper side area of an outlet tube 30, as seen in FIG. 3. As such, water is introduced at two separates sites within each nitrogen flow.

The spray nozzles 22 are atomizing nozzles that can be of a type known in the art, and water that enters each spray nozzle 22 is atomized and introduced into one of the streams of dry nitrogen as or after the stream has traveled past the spray nozzles 22 to the outlet tubes 30, resulting in the nitrogen and atomized water forming a nitrogen mist within each tube 30. The nitrogen mist travels down the outlet tubes 30, after which the separate flows may be combined into a single flow path within a mist junction 36. The single flow of mist exiting the junction 36 can then be fed through a check valve 38 before exiting through the nitrogen mist outlet 20. Although the cooling system 10 is represented as comprising six spray nozzles 22 located at the top and upper side areas of each of the outlet tubes 30, it may be desirable for the cooling system to comprise fewer or more spray nozzles 22 for one or more of the nitrogen streams. Similarly, while the cooling system 10 is represented as comprising three paths for the flow of the nitrogen, water, and nitrogen mist, it is foreseeable that the cooling system 10 may have two paths, three paths, or more than three paths.

Because the water introduced into the nitrogen stream is atomized (as a nonlimiting example, droplet sizes of 200 micrometers or less), water quality can affect the conditions of the spray nozzles 22. For example, poor water quality may cause plugging within the spray nozzles 22. When flow through a spray nozzle 22 is greatly reduced, the spray nozzle 22 may require cleaning or replacement. In order to allow the spray nozzles 22 to be maintained without removing the cooling from the blast furnace, the cooling system 10 includes intake valves 42, 44, and 46 for the nitrogen, water, and mist, respectively. These valves 42, 44, and 46 provide the ability to stop the flow of nitrogen, water, and/or mist in any one or more of the individual paths without stopping the flow of nitrogen, water, and/or mist within the other paths. While the valves 42, 44, and 46, are closed to an individual flow path, the individual flow path will be isolated from the other flow paths and the spray nozzles 22 in that flow path can be safely removed for cleaning or replacement.

During setup of the cooling system 10, the water and nitrogen flows are preferably balanced. As a nonlimiting example, the water pressure is preferably at least 20 psig (about 140 kPa) greater than the nitrogen pressure in the cooling system 10. In practice, optimal water flow rates have been found to be in a range of about 2 to about 5 gpm (about 7.5 to 19 L/min), though it is foreseeable that other flow rates are possible. Increasing the water flow increases the capacity of the nitrogen mist cooling fluid to remove heat from the blast furnace. Therefore, if additional cooling capacity is required, the water flow rate may be increased. The temperature of the nitrogen mist cooling fluid after passing through the furnace cooling system is preferably less than 100° C. If this temperature rises above 100° C., water flow is preferably increased until the cooling system discharge temperature falls below 100° C. In order to setup, regulate and preferably optimize the flow of the fluid, the cooling system 10 may optionally comprise a nitrogen pressure gauge 48, a water pressure gauge 50, a water dial flowmeter 52, and a bleeder valve 54.

The cooling system 10 described herein is believed to provide several significant advantages over the prior art. The cooling system 10 supplies a cooling fluid that is believed to have a significantly higher cooling capacity than dry nitrogen. The supplied cooling fluid is capable of improving the cooling capacity of a blast furnace with a reduced likelihood to leak water into the process. The cooling system 10 is a unitary assembly, in other words, can be installed as an entire unit, which can often require less time to install relative to other systems provided in the prior art, resulting in higher furnace availability. Furthermore, the cooling system 10 does not require shutdown of the process being cooled to maintain, repair or replace any spray nozzle 22 in the event the nozzle 22 becomes plugged or fouled.

While the invention has been described in terms of a specific embodiment, it is apparent that other forms could be adopted by one skilled in the art. For example, the cooling system 10 could differ in appearance and construction from the embodiment shown in the Figures, the functions of each component of the cooling system 10 could be performed by components of different construction but capable of a similar (though not necessarily equivalent) function, and other cooling fluids may be substituted for those described. Accordingly, it should be understood that the invention is not limited to the specific embodiment illustrated in the Figures. It should also be understood that the phraseology and terminology employed above are for the purpose of disclosing the illustrated embodiment, and do not necessarily serve as limitations to the scope of the invention. Therefore, the scope of the invention is to be limited only by the following claims.

The invention claimed is:

1. A cooling system comprising:

at least one source of a gaseous fluid that feeds the gaseous fluid to multiple flow paths;

at least one source of a liquid;

atomizing means for atomizing the liquid, introducing the atomized liquid into each of the multiple flow paths, and mixing the atomized liquid with the gaseous fluid to form a mist within each of the multiple flow paths that flows through each of the multiple flow paths; and means for selectively closing and isolating a portion of each of the multiple flow paths to prevent the atomized liquid and the gaseous fluid from entering at least one of the multiple flow paths that is an isolated flow path isolated with the closing and isolating means while one or more of the multiple flow paths are non-isolated flow paths that remain open so that the mist flows therethough, the closing and isolating means providing for cleaning, repair, or removal from the cooling system of the atomizing means of the isolated flow path.

2. The cooling system of claim 1, further comprising means for regulating the flow of the gaseous fluid and the liquid within the multiple flow paths.

3. The cooling system of claim 1, wherein the gaseous fluid is dry nitrogen and the liquid is water.

4. The cooling system of claim 1, wherein the pressure of the water is at least about 140 kPa greater than the pressure of the nitrogen in the cooling system.

5. The cooling system of claim 1, wherein the atomizing means is an atomizing spray nozzle.

6. The cooling system of claim 1, further comprising means for separating the gaseous fluid from a single flow path into each of the multiple flow paths prior to introducing the atomized liquid into each of the multiple flow paths, and means for combining the mists within the multiple flow paths into a single flow path after introducing the atomized liquid into each of the multiple flow paths.

7. The cooling system of claim 1, further comprising means for separating the liquid from a single flow path into each of the multiple flow paths.

8. The cooling system of claim 1, further comprising means for combining the mists within the multiple flow paths into a single flow path.

9. The cooling system of claim 1, wherein the cooling system is a unitary assembly adapted to be installed as an entire unit in a process apparatus.

10. The cooling system of claim 9, wherein the process apparatus is a blast furnace and the cooling system is installed to provide the mist to the blast furnace during operation thereof, and the closing and isolating means provides for cleaning, repair, or removal from the cooling system of the atomizing means of the isolated flow path during operation of the blast furnace and while the non-isolated flow paths provide the mist to the blast furnace.

11. A method of repairing or replacing a component along an individual flow path of the multiple flow paths of the cooling system of claim 1, the method comprising:

isolating the individual flow path from other flow paths of the multiple flow paths by preventing the liquid and the gaseous fluid from entering the individual flow path with the closing and isolating means; and cleaning, repairing or replacing the component of the individual flow path.

12. The method of claim 11, wherein the closing and isolating means comprises intake valves associated with the individual flow path.

13. The method of claim 11, further comprising regulating the flow of the gaseous fluid and the liquid within the multiple flow paths.

14. The method of claim 11, wherein the gaseous fluid is dry nitrogen and the liquid is water.

15. The method of claim 11, wherein the pressure of the water is at least about 140 kPa greater than the pressure of the nitrogen in the cooling system.

16. The method of claim 11, further comprising separating the gaseous fluid from a single flow path into each of the multiple flow paths, introducing the atomized liquid into non-isolated paths of the multiple flow paths, and then combining the mists within the multiple flow paths into a single flow path.

17. The method of claim 11, further comprising separating the liquid from a single flow path into each of the multiple flow paths.

18. The method of claim 11, further comprising combining the mists within the multiple flow paths into a single flow path.

19. The method of claim 11, further comprising installing the cooling system is a unitary assembly in a process apparatus.

20. The method of claim 19, wherein the process apparatus is a blast furnace and the cooling system operates to provide the mist to the blast furnace during operation thereof, and cleaning, repairing or replacing the component of the individual flow path is performed while non-isolated paths of the multiple flow paths provide the mist to the blast furnace.

* * * * *